US010811789B2

(12) United States Patent
Shinohara

(10) Patent No.: US 10,811,789 B2
(45) Date of Patent: Oct. 20, 2020

(54) CONNECTION STRUCTURE OF CABLE AND TERMINAL

(71) Applicant: Yazaki Corporation, Tokyo (JP)

(72) Inventor: Junya Shinohara, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/450,085

(22) Filed: Jun. 24, 2019

(65) Prior Publication Data

US 2019/0393624 A1 Dec. 26, 2019

(30) Foreign Application Priority Data

Jun. 26, 2018 (JP) ..... 2018-120602

(51) Int. Cl.
*H01R 4/48* (2006.01)

(52) U.S. Cl.
CPC ..... *H01R 4/48* (2013.01)

(58) Field of Classification Search
CPC ..... H01R 4/48; H01R 4/4845; H01R 4/4818; H01R 11/09
USPC ..... 439/787, 436, 834, 835
See application file for complete search history.

(56) References Cited

U.S. PATENT DOCUMENTS 1,724,729 A * 8/1929 Ruttenberg ..... H01R 4/4845 439/828
3,937,548 A * 2/1976 Dittmann ..... H01R 4/4845 439/436
4,199,211 A * 4/1980 Kidder ..... H01R 4/4818 174/84 C
5,275,620 A * 1/1994 Darby ..... A61N 1/3752 439/441
8,727,817 B2 * 5/2014 D'Hiver ..... A61N 1/3752 439/789

FOREIGN PATENT DOCUMENTS

JP 57-14370 U 1/1982
JP 2008-226671 A 9/2008

* cited by examiner

*Primary Examiner* — Hien D Vu
(74) *Attorney, Agent, or Firm* — Sughrue Mion, PLLC

(57) ABSTRACT

A connection structure of a cable and a terminal, the connection structure includes a cable including a core wire exposed from an insulating sheath, and a terminal including a base plate and at least a pair of elastic connection pieces formed to be capable of being cut-raised in the base plate, the at least a pair of elastic connection pieces each having a cable insertion hole formed therein. At least the core wire of the cable is pressed against and electrically connected to the base plate by elastic restoring force of each of the at least a pair of elastic connection pieces in a state in which at least the core wire of the cable is inserted in the cable insertion hole formed in each of the at least a pair of elastic connection pieces.

6 Claims, 2 Drawing Sheets

CONNECTION STRUCTURE OF CABLE AND TERMINAL

CROSS REFERENCE TO RELATED APPLICATION

This application is based upon and claims the benefit of priority from the prior Japanese Patent Application No. 2018-120602, filed on Jun. 26, 2018, the entire contents of which are incorporated herein by reference.

BACKGROUND

Technical Field

The disclosure relates to a connection structure of a terminal and a cable including a core wire constituted by extremely thin strands.

Related Art

As a connection structure of a cable and a terminal of this type, there is one disclosed in JP 2008-226671 A. The connection structure of a cable and a terminal described in this patent document includes a terminal including a terminal connecting portion to which a mating terminal is connected and a cable connecting portion to which a cable is connected, and a cable including an extremely thin core wire exposed from an insulating sheath.

Then, the insulating sheath of the cable is crimped to an insulation barrel of the cable connecting portion of the terminal, and the extremely thin core wire of the cable is crimped to a wire barrel at the front and rear of the cable connecting portion of the terminal.

However, in the conventional connection structure of a cable and a terminal, since the core wire of the cable is pierced into the tip of the wire barrel of the terminal and crimped with a crimping die, when the strands of the core wire of the cable are extremely thin, the core wire breaks. Also, a connection product of a terminal and a cable is restricted by the dimensions of the crimping die constituted by a crimper, an anvil or the like, and therefore cannot support an application as a connector of a narrow pitch.

SUMMARY

The disclosure is directed to a connection structure of a cable and a terminal capable of connecting a cable and a terminal easily and reliably without breaking the core wire of the cable and capable of supporting an application as a narrow pitch connector.

A connection structure of a cable and a terminal according to an embodiment includes a cable including a core wire exposed from an insulating sheath, and a terminal including a base plate and at least a pair of elastic connection pieces formed to be capable of being cut-raised in the base plate, the at least a pair of elastic connection pieces each having a cable insertion hole formed therein. At least the core wire of the cable is pressed against and electrically connected to the base plate by elastic restoring force of each of the at least a pair of elastic connection pieces in a state in which at least the core wire of the cable is inserted in the cable insertion hole formed in each of the at least a pair of elastic connection pieces.

According to the connection structure of a cable and a terminal according to the above configuration, by merely inserting at least the core wire among the core wire and the insulating sheath of the cable in the cable insertion hole of the elastic connection piece of the base plate, the cable and the terminal can be easily and reliably connected and application as a narrow pitch connector can be supported without breaking the core wire.

DETAILED DESCRIPTION

Figure 1:
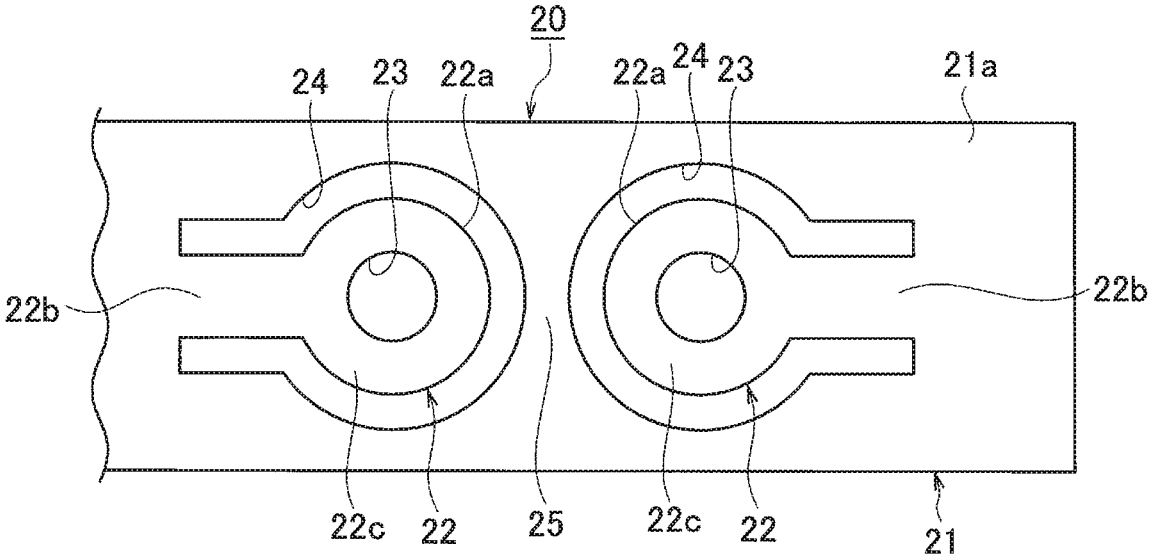
FIG. 1 is a plan view illustrating a state of a terminal of a connection structure of a cable and a terminal of a first embodiment before connecting a cable.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2A:
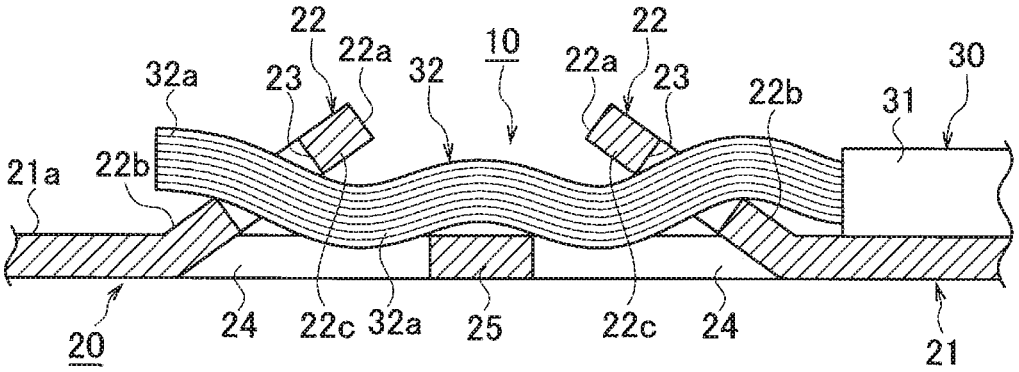
FIG. 2A is a section view illustrating a state of the connection structure of a cable and a terminal of the first embodiment after completing connection through a plurality of members.
Figure 2B:
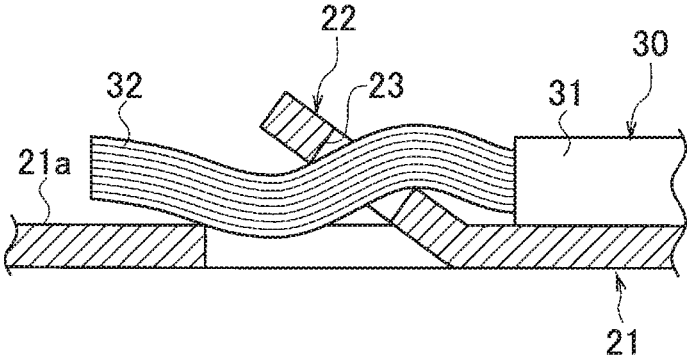
FIG. 2B is a section view illustrating a state of a reference example after completing connection through one member.

FIG. 1 is a plan view illustrating a state of a terminal of a connection structure of a cable and a terminal of a first embodiment before connecting a cable, FIG. 2A is a section view illustrating a state of the connection structure after completing connection through a plurality of members, and FIG. 2B is a section view illustrating a state of a reference example after completing connection through one member.

As illustrated in FIGS. 1 to 2B, a connection structure 10 of a cable and a terminal includes a terminal 20 including a conductive bottom plate (base plate) 21 and a pair of elastic connection pieces (spring pieces) 22 formed to be capable of being cut-raised in the bottom plate 21, and a cable 30 including a core wire 32 constituted by extremely thin strands 32*a* exposed from an insulating sheath 31. A cable insertion hole 23 is formed in each of the pair of elastic connection pieces 22. The core wire 32 of the cable 30 constituted by extremely thin strands 32*a* exposed from the insulating sheath 31 is inserted in the cable insertion hole 23 of each of the elastic connection pieces 22, and is pressed against (urged toward) and electrically and mechanically connected to an upper surface 21*a* of the bottom plate 21 by the elastic restoring force (reaction force) of the elastic connection pieces 22.

The bottom plate 21 of the terminal 20 is formed in a rectangular plate shape from metal, and has a terminal connecting portion, which is not illustrated and to which a mating terminal is connected, on the front thereof. In addition, the pair of elastic connection pieces 22 are formed at the center of the bottom plate 21 to be capable of being cut-raised via notches 24 each formed in a substantially U-shaped slit shape. The pair of elastic connection pieces 22 are capable of being cut-raised such that respective distal ends 22*a* thereof face each other with a boundary portion 25 of a predetermined length therebetween. Therefore, one of the pair of elastic connection pieces 22 of the first embodiment is capable of being cut-raised in a direction facing to the front and the other is capable of being cut-raised in a direction facing toward a base portion. A circular cable insertion hole 23 is formed in a rounded plate portion 22*c* at the center between the distal end 22*a* and a proximal end 22*b* of each of the elastic connection pieces 22.

The respective distal ends 22*a* of the pair of elastic connection pieces 22 formed in the bottom plate 21 are raised with the respective proximal ends 22*b* as fulcrums, and the core wire 32 of the cable 30 exposed from the insulating sheath 31 is inserted in the cable insertion hole 23 of each of the elastic connection pieces 22. When the elastic connection pieces 22 are released in a state in which the core wire 32 is inserted in the cable insertion holes 23, the core wire 32 is pressed against and electrically connected to the upper surface 21*a* of the boundary portion 25 of the bottom plate 21 by the elastic restoring force of the elastic connection pieces 22, and this state is maintained.

According to the connection structure 10 of a cable and a terminal of the first embodiment described above, by just releasing a lift-up state of the pair of elastic connection pieces 22 after inserting the core wire 32 of the cable 30 constituted by the extremely thin strands 32*a* and exposed from the insulating sheath 31 in the cable insertion holes 23 of the pair of elastic connection pieces 22 whose distal ends 22*a* are lifted up, the core wire 32 is pressed against and connected to the upper surface 21*a* of the boundary portion 25 of the bottom plate 21 by the elastic restoring force (reaction force) of the pair of elastic connection pieces 22, and this state can be maintained. Therefore, the terminal 20 and the cable 30 can be easily and reliably connected without braking the core wire 32 of the cable 30 constituted by the extremely thin strands 32*a*.

Further, by connecting the core wire 32 of the cable 30 to the upper surface 21*a* of the boundary portion 25 of the bottom plate 21 by pressing the core wire 32 against the upper surface 21*a* by the elastic restoring force of the pair of elastic connection pieces 22, the retention force of the connection state of the core wire 32 of the cable 30 to the bottom plate 21 can be enhanced much more than the case where the core wire 32 of the cable 30 is connected by pressing the core wire 32 by the restoring force of just one elastic connection piece 22 illustrated in FIG. 2B.

Furthermore, since the pair of elastic connection pieces 22 are formed to be capable of being cut-raised in directions facing each other across the boundary portion 25 (in a substantially inverted V shape in side view when lifted), a force suppressing the movement of the cable 30 is applied in both of an inserting direction and a pulling-out direction of the cable 30. Therefore, it is possible to maintain a stable electrical connection state even in a vehicle environment where vibration or the like occurs during traveling.

Furthermore, since the terminal 20 and the cable 30 can be connected simply by inserting the core wire 32 of the cable 30 exposed from the insulating sheath 31 of the cable 30 in the cable insertion holes 23 of the pair of elastic connection pieces 22 that have been raised, the connection product of the terminal 20 and the cable 30 is not restricted to the dimensions of the crimping die constituted by a crimper, an anvil or the like as in the conventional crimping connection. Therefore, the connection structure 10 of a cable and a terminal can be applied to a narrow pitch connector. In addition, it becomes also possible to share pressurizing parts, so that cost reduction can be achieved.

Figure 3:
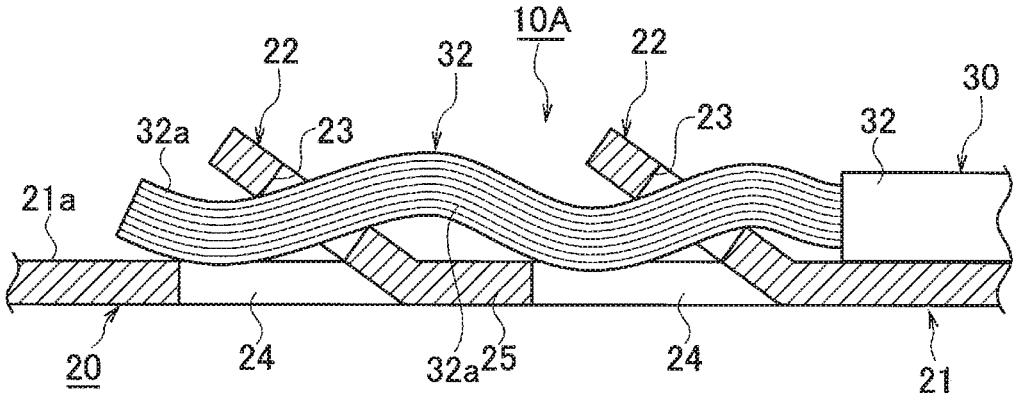
FIG. 3 is a section view illustrating a state of the connection structure of a cable and a terminal of a second embodiment after completing connection through a plurality of members.

FIG. 3 is a section view illustrating a state of the connection structure of a cable and a terminal of a second embodiment after completing connection through a plurality of members.

A connection structure 10A of a cable and a terminal of the second embodiment is different from the first embodiment in that the pair of elastic connection pieces 22 of the bottom plate (base plate) 21 are formed to be capable of being cut-raised in the same direction that is a direction facing the front of the bottom plate 21. In the second embodiment as well, the core wire 32 of the cable 30 exposed from the insulating sheath 31 is inserted in the cable insertion holes 23 of the pair of elastic connection pieces 22, and thus the core wire 32 is pressed against and connected to the bottom plate 21. Since other elements are the same as those of the first embodiment, the elements are denoted by the same reference numerals, and a detailed description thereof will be omitted.

In the connection structure 10A of a cable and a terminal according to the second embodiment, the terminal 20 and the cable 30 can be easily and reliably connected at the upper surface 21*a* of the boundary portion 25 of the bottom plate 21 without breaking the core wire 32 of the cable 30 constituted by the extremely thin strands 32*a*, by easily inserting the core wire 32 of the cable 30 exposed from the insulating sheath 31 in the cable insertion holes 23 of the pair of elastic connection pieces 22 formed to be capable of being cut-raised in the same direction facing the front of the bottom plate 21.

Figure 4:
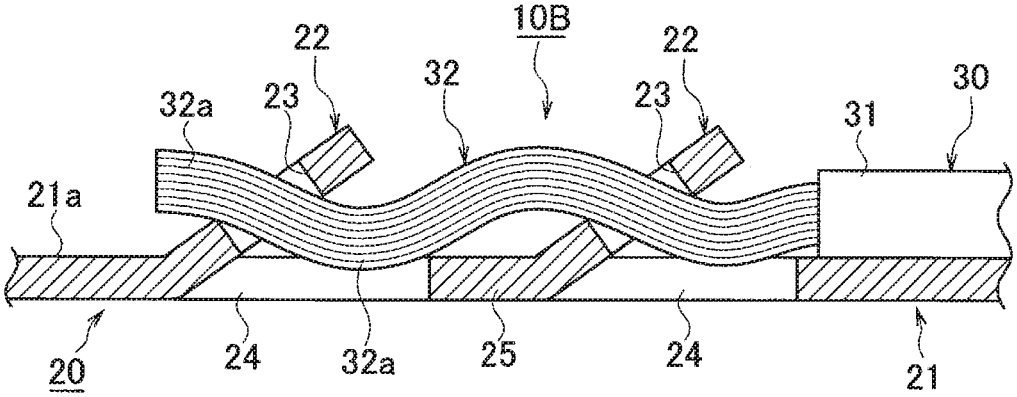
FIG. 4 is a section view illustrating a state of the connection structure of a cable and a terminal of a third embodiment after completing connection through a plurality of members.

FIG. 4 is a section view illustrating a state of the connection structure of a cable and a terminal of a third embodiment after completing connection through a plurality of members.

A connection structure 10B of a cable and a terminal of the third embodiment is different from the other embodiments in that the pair of elastic connection pieces of the bottom plate (base plate) 21 are formed to be capable of being cut-raised in the same direction that is a direction facing toward a base portion of the bottom plate 21. In the third embodiment as well, the core wire 32 of the cable 30 exposed from the insulating sheath 31 is inserted in the cable insertion holes 23 of the pair of elastic connection pieces 22, and thus the core wire 32 is pressed against and connected to the bottom plate 21. Since other elements are the same as those of the first embodiment, the elements are denoted by the same reference numerals, and a detailed description thereof will be omitted.

In the connection structure 10B of a cable and a terminal according to the third embodiment, the terminal 20 and the cable 30 can be easily and reliably connected at the upper surface 21*a* of the bottom plate 21 without breaking the core wire 32 of the cable 30 constituted by the extremely thin strands 32*a*, by inserting the core wire 32 of the cable 30 exposed from the insulating sheath 31 in the cable insertion holes 23 of the pair of elastic connection pieces 22 formed to be capable of being cut-raised in the same direction facing toward the base portion of the bottom plate 21.

Figure 5:
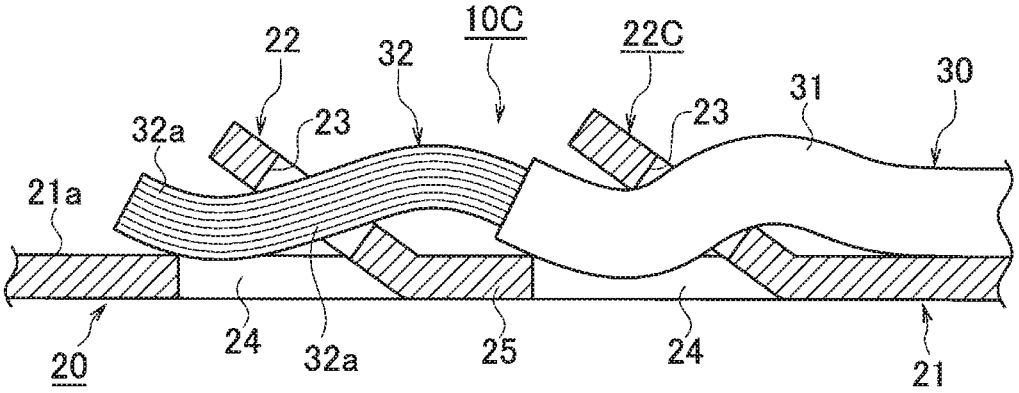
FIG. 5 is a section view illustrating a state of the connection structure of a cable and a terminal of a fourth embodiment after completing connection of a core wire and an insulating sheath.

FIG. 5 is a section view illustrating a state of the connection structure of a cable and a terminal of a fourth embodiment after completing connection of a core wire and an insulating sheath.

A connection structure 10C of a cable and a terminal of the fourth embodiment is different from the other embodiments in that a pair of elastic connection pieces 22 and 22C each having the cable insertion hole 23 are formed to be capable of being cut-raised in the same cut-raising direction from the bottom plate (base plate) 21, and that the elastic connection piece 22C closer to the base portion is formed to be larger than the elastic connection piece 22 closer to the front of the bottom plate 21. In the fourth embodiment, the core wire 32 of the cable 30 constituted by the extremely thin strands 32*a* exposed from the insulating sheath 31 is inserted in the cable insertion hole 23 of the elastic connection piece 22 closer to the front, and thus the core wire 32 is pressed against and electrically and mechanically connected to the bottom plate 21. Further, the cable 30 is inserted in the cable insertion hole 23 of the elastic connection piece 22C closer to the base portion, and thus the insulating sheath 31 of the cable 30 is pressed against and mechanically connected to the bottom plate 21. Since other elements are the same as those of the first embodiment, the elements are denoted by the same reference numerals, and a detailed description thereof will be omitted.

That is, in the connection structure 10C of a cable and a terminal of the fourth embodiment, the insulating sheath 31 and the core wire 32 of the cable 30 can be easily and reliably pressed against and connected to the upper surface 21*a* side of the bottom plate 21, and thus the same actions and effects as in the first embodiment are achieved.

In each of the above embodiments, three or more elastic connection pieces each having a cable insertion hole may be formed in order to increase the retention force.

In addition, although the pair of elastic connection pieces are formed in directions facing each other (in a substantially inverted V shape in side view when lifted) in the first embodiment, the pair of elastic connection pieces may be formed in directions not facing each other (in a substantially V shape in side view when lifted).

Further, although the pair of elastic connection pieces are formed in the same direction in the fourth embodiment, the pair of elastic connection pieces may be formed in directions facing each other (in a substantially inverted V shape in side view when lifted) or in directions not facing each other (in a substantially V shape in side view when lifted), and thus the insulating sheath and the core wire of the cable may be each pressed and connected.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connection structure of a cable and a terminal, the connection structure comprising:

a cable including a core wire exposed from an insulating sheath; and a terminal including a base plate and at least a pair of elastic connection pieces cut-raised via notches in the base plate so as to extend upwardly therefrom, the at least a pair of elastic connection pieces each having a cable insertion hole formed therein, wherein at least the core wire of the cable is pressed against and electrically connected to the base plate by elastic restoring force of each of the at least a pair of elastic connection pieces in a state in which at least the core wire of the cable is inserted in the cable insertion hole formed in each of the at least a pair of elastic connection pieces.

2. The connection structure of a cable and a terminal according to claim 1, wherein cut-raising directions of the at least a pair of elastic connection pieces are different.

3. The connection structure of a cable and a terminal according to claim 1, wherein cut-raising directions of the at least a pair of elastic connection pieces are the same.

4. The connection structure of a cable and a terminal according to claim 1, wherein the core wire of the cable exposed from the insulating sheath is inserted in the cable insertion hole formed in each of the at least a pair of elastic connection piece, and the core wire exposed from the insulating sheath is pressed against and electrically connected to the base plate.

5. The connection structure of a cable and a terminal according to claim 1, wherein the core wire of the cable exposed from the insulating sheath is inserted in the cable insertion hole formed in one of the at least a pair of elastic connection pieces, and thus the core wire exposed from the insulating sheath is pressed against and electrically connected to the base plate, and the cable is inserted in the cable insertion hole formed in another of the at least a pair of elastic connection pieces, and thus the insulating sheath of the cable is pressed against and mechanically connected to the base plate.

6. The connection structure of a cable and a terminal according to claim 1, wherein the core wire of the cable when pressed against and electrically connected to the base plate by elastic restoring force of each of the at least a pair of elastic connection pieces assumes a serpentine shape.

* * * * *